US007374155B2

(12) United States Patent
Tobinai

(10) Patent No.: US 7,374,155 B2
(45) Date of Patent: May 20, 2008

(54) DIAPHRAGM CARBURETOR AND METHOD OF ASSEMBLY

(75) Inventor: Teruhiko Tobinai, Sendai (JP)

(73) Assignee: Walbro Engine Management, L.L.C., Tucson, AZ (US)

( * ) Notice: Subject to any disclaimer, the term of this patent is extended or adjusted under 35 U.S.C. 154(b) by 237 days.

(21) Appl. No.: 11/321,916

(22) Filed: Dec. 29, 2005

(65) Prior Publication Data

US 2006/0151892 A1 Jul. 13, 2006

(30) Foreign Application Priority Data

Jan. 11, 2005 (JP) ..... 2005-003355

(51) Int. Cl.
*F02M 17/04* (2006.01)

(52) U.S. Cl. ..... 261/35; 29/525.11; 261/44.8; 261/69.1

(58) Field of Classification Search ..... 261/35, 261/44.8, 69.1, 69.2, DIG. 68; 29/525.11
See application file for complete search history.

(56) References Cited

U.S. PATENT DOCUMENTS 2,680,605 A * 6/1954 Bracke ..... 261/63
3,250,224 A * 5/1966 Phillips et al. ..... 417/479
3,825,237 A * 7/1974 Aoyama et al. ..... 261/35
4,046,844 A * 9/1977 Rickert ..... 261/34.2
4,168,288 A * 9/1979 Nau et al. ..... 261/35
5,706,774 A * 1/1998 Shaw ..... 123/179.11
6,135,429 A * 10/2000 Woody ..... 261/35
6,431,527 B1 * 8/2002 Suzuki et al. ..... 261/44.3
6,446,939 B1 * 9/2002 Hoppe et al. ..... 261/35
2001/0048167 A1 * 12/2001 Pattullo et al. ..... 261/35
2003/0221650 A1 * 12/2003 Shaw ..... 123/179.11

FOREIGN PATENT DOCUMENTS

JP 4-339161 A * 11/1992 ..... 261/DIG. 68

* cited by examiner

*Primary Examiner*—Richard L. Chiesa
(74) *Attorney, Agent, or Firm*—Reising, Ethington, Barnes, Kisselle, P.C.

(57) ABSTRACT

A diaphragm carburetor for an internal combustion engine and method of assembly includes attaching an air-fuel mixing body to a fuel metering chamber assembly independent from assembling the fuel metering chamber assembly. The fuel metering chamber assembly has an upper body and a lower body attached to one another by at least one fastener with a diaphragm carried therebetween. A fuel metering chamber is defined on one side of the diaphragm and an atmospheric chamber is defined on another side of the diaphragm. Another fastener attaches the fuel metering chamber assembly to the air-fuel mixing body independently from the fastener attaching the upper and lower bodies together. Accordingly, the fuel metering chamber assembly is removable from the air-fuel mixing body without removing the fastener attaching the upper and lower bodies to one another preferably for cleaning of a fuel nozzle that when assembled projects into an air-fuel mixing passage in the mixing body.

21 Claims, 3 Drawing Sheets

DIAPHRAGM CARBURETOR AND METHOD OF ASSEMBLY

REFERENCE TO RELATED APPLICATION

Applicant claims priority of Japanese application, Ser. No. 2005-003355-filed Jan. 11, 2005.

FIELD OF THE INVENTION

The present invention relates generally to carburetors and more particularly to diaphragm carburetors and their method of assembly.

BACKGROUND OF THE INVENTION

For many decades small internal combustion engines, such as those used for motor vehicles, recreational vehicles and lawn and garden tools like chain saws, trimmers, tractors, and lawn mowers, have typically used diaphragm carburetors to regulate the air-fuel mixture supplied to the internal combustion engine. Typically diaphragm carburetors have a main body with an air-fuel mixing passage adapted for fluid communication with a fuel metering chamber assembly, which in turn is in fluid communication with a fuel pump chamber. The fuel metering chamber assembly is typically constructed from separate bodies attached to one another with a diaphragm carried between the separate bodies. The fuel metering chamber assembly provides a regulated supply of liquid fuel to the air-fuel mixing passage, typically through a fuel nozzle having a relatively small diameter fuel passage. The fuel passage of the fuel nozzle typically terminates within the air-fuel mixing passage and in rotary throttle valve connectors is commonly adapted for close receipt of a needle valve. The needle valve typically moves relative to the fuel nozzle to regulate, at least in part, the amount of liquid fuel flowing through the fuel nozzle into the air-fuel mixing chamber.

Unfortunately, in use, the fuel passage of the fuel nozzle commonly gets clogged, at least partially, with dirt, dust, or the like. When the fuel passage becomes clogged, the running performance and efficiency of the engine declines, and unless the fuel nozzle is cleaned, the engine can stop running altogether. Accordingly, the fuel nozzle, and/or other components of the carburetor, typically require periodic cleaning.

Cleaning diaphragm carburetors can prove challenging. Typically, to clean the fuel nozzle, the fuel metering chamber assembly needs to be disassembled from the air-fuel mixing body. While disassembling the fuel metering chamber assembly, the upper and lower bodies of the assembly are typically able to separate from one another, thereby exposing the diaphragm between the bodies to potential contamination and damage. Accordingly, while attempting to clean the fuel nozzle, typically three separate bodies can separate from one another, thereby increasing the potential for further contamination. Thus, efforts to clean the fuel nozzle are generally complicated, labor intensive and can result in additional contamination of the carburetor.

SUMMARY OF THE INVENTION

A diaphragm carburetor for an internal combustion engine includes an air-fuel mixing body and a fuel metering chamber assembly separable from one another independently from separation of components of the fuel metering chamber assembly. The fuel metering chamber assembly has an upper body and a lower body plates attached to one another by at least one fastener with a diaphragm carried between the bodies. The upper body and diaphragm define a fuel metering chamber on one side of the diaphragm and the lower body and diaphragm define an atmospheric chamber on the other side of the diaphragm. Another fastener attaches the fuel metering chamber assembly to the air-fuel mixing body independently from the fastener attaching the upper and lower bodies together. Accordingly, the fuel metering chamber assembly is removable from the air-fuel mixing body without removing the fastener attaching the upper and lower bodies to one another.

Preferably, the throttle valve is of a rotary type that rotates about and moves axially along an axis disposed substantially perpendicular to the air-fuel mixing passage. A fuel nozzle and preferably a fuel restricting orifice cartridge projects upward from the upper body and removably into the mixing body. The fuel nozzle is disposed concentrically to the axis and controllably ejects fuel into the mixing passage dependent upon the throttle valve angular placement. The elongated fuel restricting orifice cartridge is substantially parallel to the fuel nozzle and interposes a fuel passage extending between the fuel metering chamber and the fuel nozzle. A lower leg portion of the fuel passage is in the upper body and extends between a port and the fuel nozzle so that when the fuel metering chamber assembly is removed from the mixing body compressed air for cleaning of the fuel nozzle can be blown through the nozzle, lower leg portion and port without communicating with or effecting the metering diaphragm.

Another aspect of the invention includes a method of assembling a diaphragm carburetor by attaching the upper body to the lower body with a metering diaphragm between them by at least one fastener to assemble the fuel metering chamber assembly, and attaching the fuel metering chamber assembly to the air-fuel mixing body with another fastener separate from the fastener used to attach the upper and lower bodies together.

Objects, features and advantages of this invention include a carburetor that is easily disassembled for cleaning and maintenance of internal components while protecting and making other components less susceptible to damage. Other advantages include greater flexibility in carburetor packaging to an engine-driven apparatus, reduced manufacturing and assembly costs, a simple robust design, and a carburetor that is reliable, durable and in service has a long and useful life.

BRIEF DESCRIPTION OF THE DRAWINGS

These and other objects, features and advantages of this invention will be apparent from the following detailed description of the preferred embodiments and best mode, appended claims, and accompanying drawings in which:

DETAILED DESCRIPTION OF PREFERRED EMBODIMENTS

Figure 1:
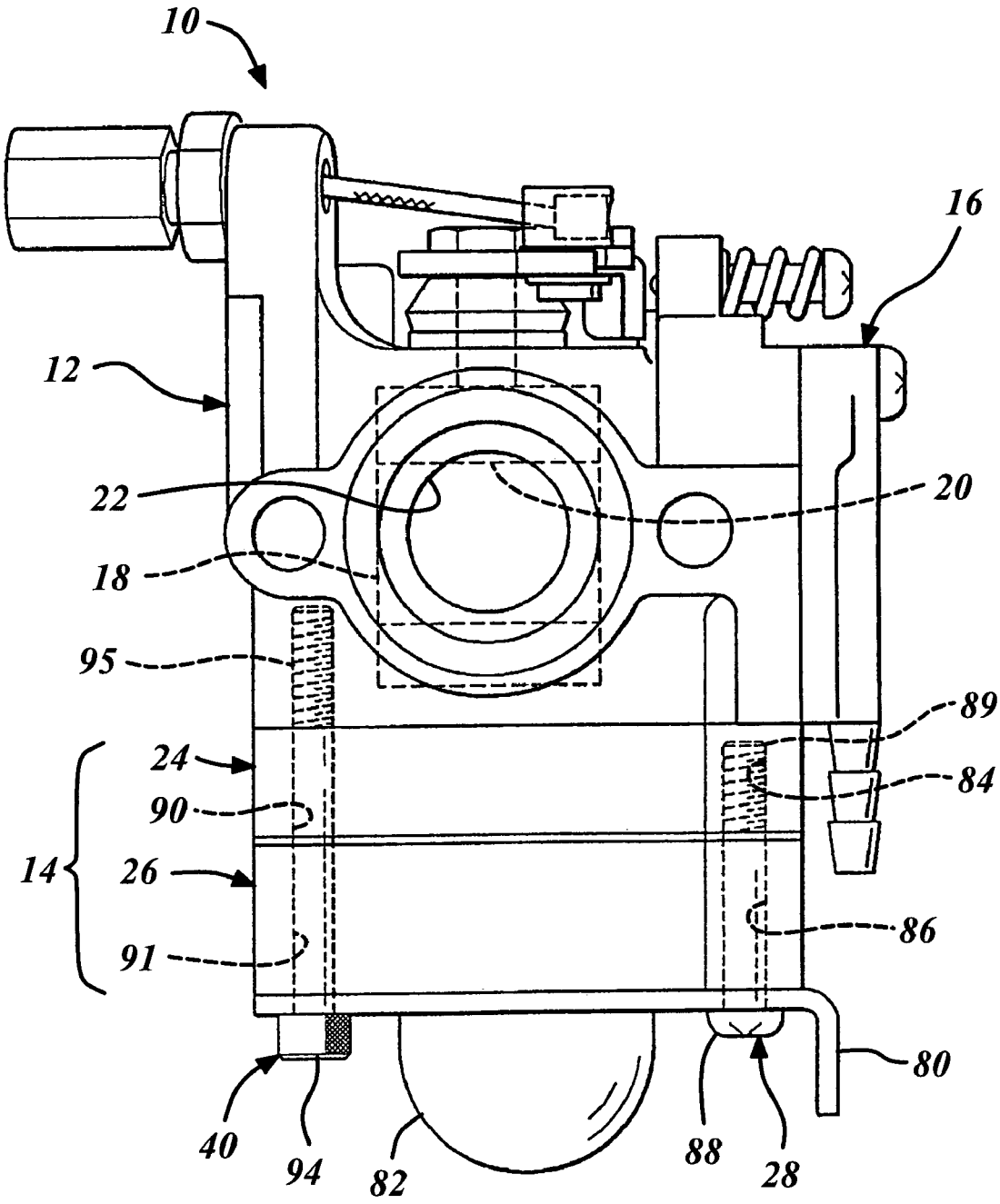
FIG. 1 is a front end view of a carburetor illustrating a fuel metering chamber assembly according to one presently preferred embodiment attached to an air-fuel mixing body of the carburetor.
Figure 2:
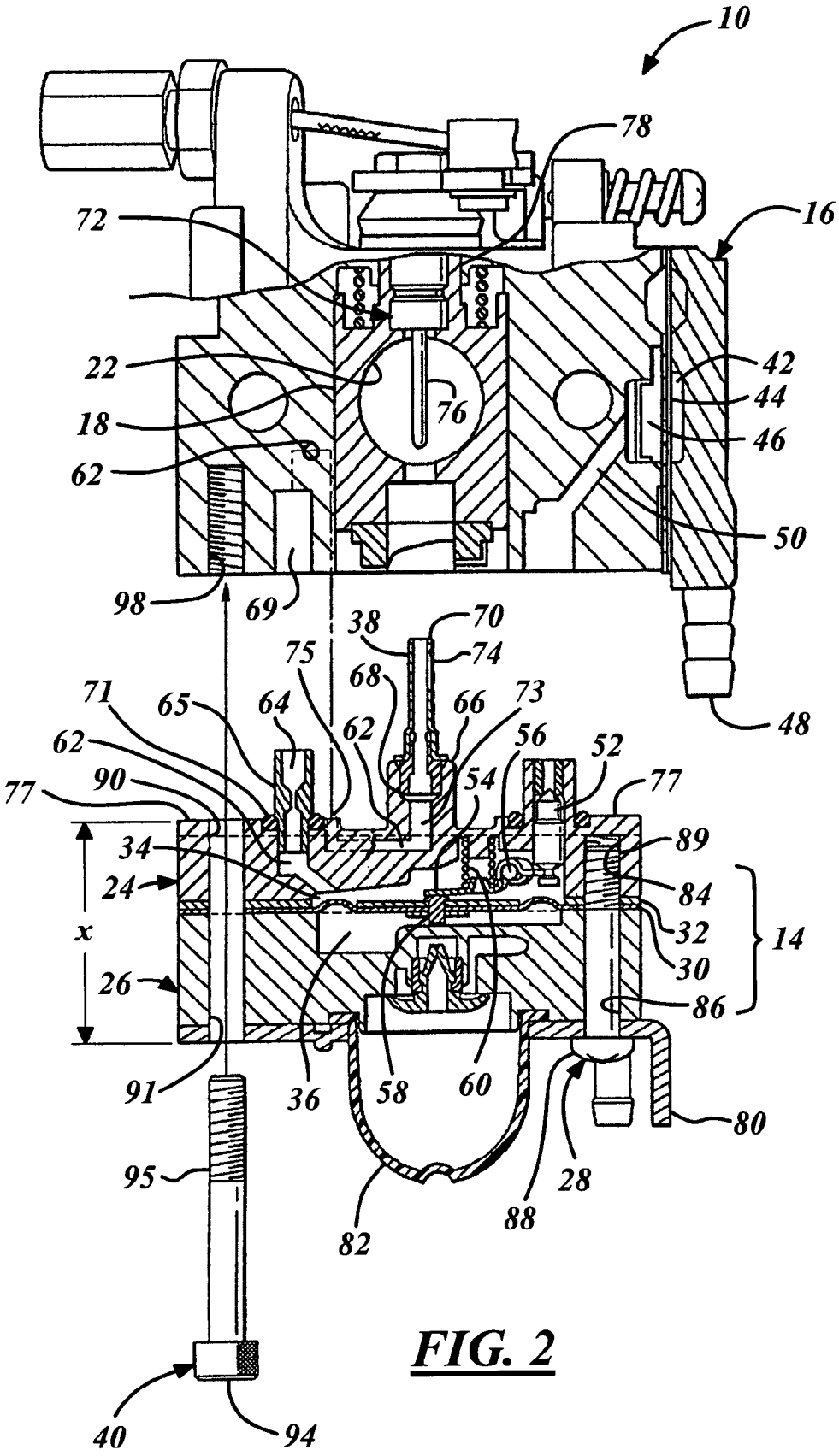
FIG. 2 is a partial by exploded cross-sectional view of the carburetor of FIG. 1 showing the fuel metering assembly disassembled from the air-fuel mixing body.

Referring in more detail to the drawings, FIG. 1 illustrates a carburetor 10 having a main body 12 with a fuel metering chamber assembly 14, according to one presently preferred embodiment, attached to an air-fuel mixing portion or main body 16. The air-fuel mixing body 16 has an air-fuel mixture passage 20, a throttle valve 18 adapted for rotation about an axis 21, represented here as a rotary throttle valve, with a transverse through bore 22, by way of example and without limitation, and received in the air-fuel mixing passage 20. The fuel metering chamber assembly 14 has a metering chamber plate or upper body 24 and an atmospheric chamber plate or lower body 26, attached to one another via at least one, and preferably a pair of fasteners such as machine screws 28. As shown in FIG. 2, a diaphragm 30 and preferably a gasket or seal 32 are received between the upper and lower bodies 24, 26, to provide a fuel control or metering chamber 34 and an atmospheric chamber 36 on opposite sides of the diaphragm 30. A fuel nozzle 38 is attached to the upper body 24 for receipt within the air-fuel mixing passage 20 to provide a flow path for liquid fuel into the mixing passage 20. The fuel metering chamber assembly 14 is attachable to the air-fuel mixing body 16 via at least one and preferably a pair of fasteners such as machine screws 40. As such, the fuel metering chamber assembly 14 can be removed from the air-fuel mixing body 16 without having to disassemble the upper and lower bodies 24, 26 from one another. Accordingly, the fuel nozzle 38 can be accessed for cleaning without having to disassemble the diaphragm 30 and/or upper and lower bodies 24, 26 from one another, thereby reducing the potential of contaminating and/or damaging the fuel metering chamber 34.

As shown in FIG. 2, the main body 12 has a pulsating pressure chamber 42 communicating with a crankcase of an engine (not shown) to receive pulsating pressure therefrom. A pump diaphragm 44 separates the pressure chamber 42 from a pump chamber 46 defined on the other side of the pump diaphragm 44. The pump chamber 46 communicates with an external fuel tank (not shown) via a passage 48 defined in the main body 12. Desirably, the passage 48 has a one way check valve (not shown) to facilitate regulating the flow of liquid fuel between the fuel tank and the pump chamber 46 as the pump diaphragm 44 reciprocates under the pulsating pressure from the crankcase.

The pump chamber 46 is in fluid communication with the metering chamber 34 via a fuel passage 50. To facilitate regulating the flow of liquid fuel through the passage 50 into the metering chamber 34, preferably a fuel regulator valve 52 moveable between open and closed positions is interposed generally between the metering chamber 34 and the pump chamber 46. The fuel regulator valve 52 has a lever 54 pivotally supported by a pivot shaft 56 inside the metering chamber 34. When the fuel regulator valve 52 is in its open position, liquid fuel is generally free to flow into the metering chamber 34, and when in its closed position, liquid fuel is prevented from entering the metering chamber 34.

The metering chamber 34 is defined between the diaphragm 30 and the upper body 24, while the atmospheric chamber 36 is defined on an opposite side of the diaphragm 30 between the diaphragm 30 and the lower body 26. The diaphragm 30 has a generally central projection 58 that abuts the lever 54 to regulate its movement about the pivot shaft 56, and thus, the movement of the fuel regulator valve 52 between its open and closed positions. When the pressure in the metering chamber 34 is less than the pressure in the atmospheric chamber 36, the diaphragm 30 deflects upwardly, and thus, the projection 58 pivots the lever 54 about the pivot shaft 56 in a clockwise direction, as viewed in FIG. 2, thereby moving the fuel regulator valve 52 to its open position. When the pressure in the metering chamber 34 is equal to or less than the pressure in the atmospheric chamber 36, the fuel regulator valve 52 remains in its closed position. To facilitate maintaining the fuel regulator valve 52 in its closed position when the pressure in the metering chamber 34 is equal to or less than the pressure in the atmospheric chamber 36, preferably a spring 60 biases the lever 54 to its closed position.

The metering chamber 34 is in fluid communication with the air-fuel mixing passage 20 via a fuel passage 62. In the embodiment show, by way of example and without limitations, the fuel passage 62 includes a flow restricting orifice 64 to facilitate regulating the flow of liquid fuel therethrough. The passage 62 terminates downstream from the flow restricting orifice 64 at an end 66 adapted for receipt of the fuel nozzle 38. The fuel nozzle 38 has one end 68 that is preferably attached to the end 66 of the fuel passage 62, such as through a press or threaded engagement, for example, and a free end 70 adapted for termination within the air-fuel mixing passage 20 and for operable communication with a needle valve 72. A main fuel jet or orifice 74 is preferably formed in a sidewall of the fuel nozzle 38 generally adjacent the free end 70.

The flow restricting orifice 64 is preferably carried by a substantially cylindrical and removable cartridge 65 that defines in part the passage 62. The cartridge 65 is supported by and projects upward from the upper body 24. When the carburetor 10 is assembled, the cartridge 65 fits snugly in part in a bore 67 in the upper body 24 that communicates with the metering chamber 34 and preferably relatively loosely in a bore 69 in the mixing body 16 that communicates with a downstream portion of the passage 62. Preferably, a resilient gasket or O-ring 71 fits snugly in a counterbore of bore 67 in the upper body 24 providing a radial seal between the upper body 24 and cartridge 65 and an axial seal between the upper body 24 and mixing body 16. When the carburetor 10 is assembled, the cartridge 65, the fuel nozzle 38 and the needle valve 72 are substantially parallel to one-another for easy disassembly of the fuel metering chamber assembly 14 from the air-fuel mixing body 16 in an axial direction.

The needle valve 72 has a needle 76 that extends into the air-fuel mixing passage 20 and into the fuel nozzle 38 for close rotational and sliding movement therein. The needle valve also preferably has an enlarged externally threaded portion 78 for mating threaded engagement with a threaded bore in the throttle valve 18. With the needle 76 in a fully closed state, corresponding to the throttle valve 18 being in a fully closed and/or idle position, the main orifice 74 in the fuel nozzle 38 is substantially restricted or closed off to fuel flow. With the needle 76 in a fully open position, corresponding to the throttle valve 18 being in a wide-open position, the main orifice 74 is preferably substantially open to fuel flow.

Figure 3:
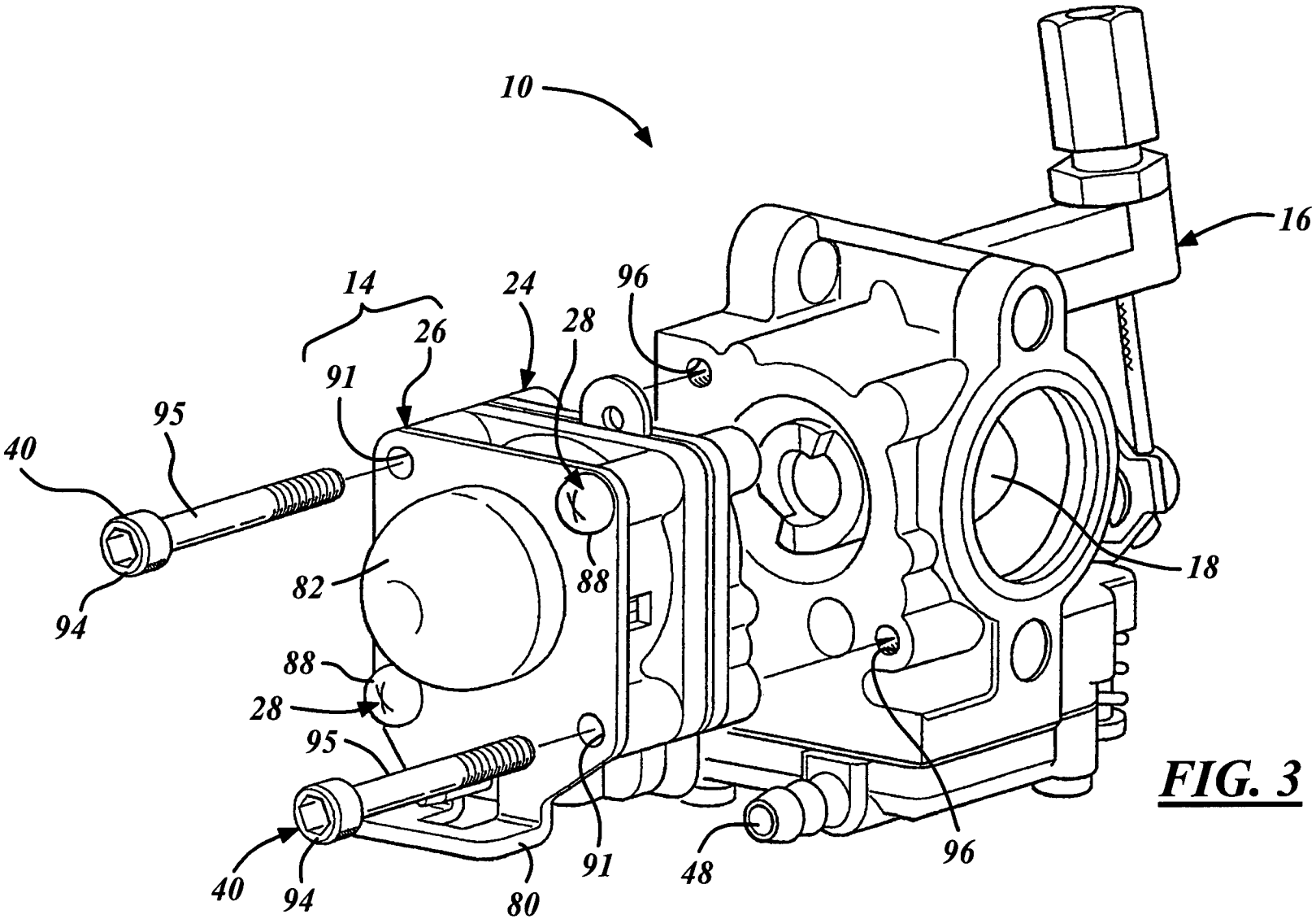
FIG. 3 is a perspective view of the carburetor of FIG. 1 showing the fuel metering chamber assembly disassembled from the air-fuel mixing body.

As shown in FIG. 3, the upper and lower bodies 24, 26 of the fuel metering chamber assembly 14 are attached to one another via the pair of fasteners, represented here, for example, as threaded fasteners 28, adjacent two corners preferably diagonally of the bodies 24, 26. Upon being stacked together, with the diaphragm 30 and seal 32 therebetween, a height (X) is defined (FIG. 2) across opposite faces of the upper and lower bodies, wherein the height X, by way of example and without limitations, also includes a thickness of a bracket 80 used for incorporating a prime or purge bulb 82. As shown in FIGS. 1 and 2, wherein only one of the fasteners 28 is shown, the upper body 24 has threaded bores, shown here as blind threaded bores 84, by way of example and without limitation, for threaded engagement with the fasteners 28. The lower body 26 is represented, by way of example and without limitation, as having through openings 86 adapted for axial alignment with the blind bores 84 in the upper body 24, wherein the through openings 86 preferably provide a clearance fit of the fasteners 28.

The fasteners 28 include a head 88 and threaded shank 89 having a length such that upon fastening the upper body 24 and lower body 26 together, the heads 88 engage the bracket 80 and the threaded shanks 89 are threaded within the threaded bores 84 of the upper body 24, and preferably terminate therein. Accordingly, the fasteners 28 preferably have a length equal to or less than the stacked height X. Thus, the upper and lower bodies 24, 26 can be attached to one another via the fasteners 28 independent from and without interfering with attachment of the fuel metering chamber assembly 14 to the air-fuel mixing body 16. Upon attaching the upper and lower bodies 24, 26 to one another via the fasteners 28, the metering chamber 34 and atmospheric chamber 36 are substantially sealed by the force produced by the fasteners 28 to prevent entry of contamination therein, with the exception of the fuel passage 50, the flow restricting orifice 64, and the fuel nozzle 38.

As shown in FIG. 3, the upper and lower bodies 24, 26 of the fuel metering chamber assembly 14 are attached to the air-fuel mixing body 16 via the pair of fasteners, represented here, for example, as threaded fasteners 40, adjacent two corners preferably diagonally of the bodies and alternately with the diagonal fasteners 28. As shown in FIGS. 1 and 2, wherein only one of the fasteners 40 is shown, the upper and lower bodies 24, 26 have through openings 90, 91, respectively, by way of example and without limitations, adapted for corresponding axial alignment with one another and receipt of the fasteners 40.

The fasteners 40 have a head 94 and threaded shank 95 with a length such that upon disposing the shanks 95 through the aligned through openings 90, 91, the heads 94 engage the bracket 80 and the threaded shanks 95 extend beyond the upper body 24 for threaded receipt in threaded bores 96 in the air-fuel mixing body 16. Accordingly, the shanks 95 of the fasteners 40 preferably have a length greater than the stacked height X. As such, the fuel metering chamber assembly 14 can be attached to and removed from the air-fuel mixing body 16 without removing the fasteners 28 attaching the upper and lower bodies 24, 26 to one another. It should be recognized that the fasteners 40 could have a length equal to or less than the stacked height X if a counterbore (not shown) were formed in the lower body 26 for receipt of the heads 94 of the fasteners 40 therein. In such a case, the bracket 80 could be fastened to the lower body 26 via additional fasteners, if desired.

To facilitate removal of the correct fasteners, 28, 40, preferably the fasteners 28, 40 have head configurations distinguishable from one another. For example, the fasteners 28 are represented here as pan-head screws, while the fasteners 40 are represented as hexagonal socket head cap screws.

Accordingly, when access to the fuel nozzle 38 and/or the restricting orifice cartridge 65 is desirable for periodic cleaning or maintenance, the fuel metering chamber assembly 14 can be removed from the air-fuel mixing body 16 by loosening the fasteners 94 without loosening the fasteners 28 attaching the upper and lower bodies 24, 26 in their clamped, assembled relation to one another. Upon removing the fuel metering chamber assembly 14 from the air-fuel mixing body 16, the projecting fuel nozzle 38 and cartridge 65 can be easily cleaned without adversely exposing the metering diaphragm 30. For instance, pressurized air can be blown into the fuel nozzle 38 or the main fuel jet 74 where it will flow through a lower leg portion 73 of the fuel passage 62 in the upper body 24 and exit the upper body through a port 75 carried by an upper face 77 of the upper body 24 without exposing the metering diaphragm 30. Moreover the cartridge 65 can be easily removed from the fuel metering chamber assembly 14 and then blown-out with pressurized air thereby isolating and preserving the metering diaphragm 30. In general, while cleaning the fuel nozzle 38 and cartridge 65, any potential for contamination to enter the metering chamber 34 and/or the atmospheric chamber 36 is substantially reduced. In addition, the risk of damaging the internal components within the respective chambers 34, 36, such as the lever 54 or diaphragm 30, for example, is eliminated when cleaning the fuel nozzle 38 and cartridge.

While the forms of the invention disclosed herein constitute presently preferred embodiments, others will be readily recognized by those skilled in the art. It is not intended to mention all the possible equivalent forms or ramifications of the invention herein. For example, the type, location and number of fasteners 28, 40 could be modified, as desired for the intended application. Further, other types of carburetors than represented herein could be employed. It is understood that terms used herein are merely descriptive, rather than limiting, and that various changes may be made without departing from the spirit or scope of the invention. The invention is defined by the following claims.

The invention claimed is:

1. A diaphragm carburetor for an internal combustion engine, comprising:

an air-fuel mixing body having an air-fuel mixing passage;

a fuel metering chamber assembly having a diaphragm, an upper body and a lower body fastened together by at least one first fastener with the diaphragm received between the bodies, the upper body and diaphragm defining a fuel metering chamber on one side of the diaphragm and the lower body and diaphragm defining an atmospheric chamber on the other side of the diaphragm; and at least one second fastener attaching the fuel metering chamber assembly to the air-fuel mixing body independently from said at least one first fastener attaching the upper and lower bodies together, said fuel metering chamber assembly being removable from said air-fuel mixing body without removing said at least one first fastener.

2. The diaphragm carburetor of claim 1 wherein the upper body has a threaded bore for threaded engagement with said at least one first fastener.

3. The diaphragm carburetor of claim 2 wherein the lower body has a through opening adapted for axial alignment with said threaded bore and for clearance receipt of said at least one first fastener.

4. The diaphragm carburetor of claim 2 wherein said at least one first fastener terminates within the threaded bore of the upper body.

5. The diaphragm carburetor of claim 4 wherein said at least one second fastener extends beyond the upper body for threaded receipt in said air-fuel mixing body.

6. The diaphragm carburetor of claim 2 wherein the air-fuel mixing body has a threaded opening for threaded receipt of said at least one second fastener.

7. The diaphragm carburetor of claim 6 wherein the upper body and lower body have axially aligned through openings adapted for axial alignment with said threaded opening in the air-fuel mixing body and for clearance receipt of said at least one second fastener.

8. The diaphragm carburetor of claim 1 wherein a pair of said first fasteners attach the upper and lower bodies together adjacent first diagonal corners and a pair of said second fasteners attach the fuel metering chamber assembly to the air-fuel mixing body adjacent diagonal corners alternating with said first diagonal corners.

9. The diaphragm carburetor of claim 1 wherein upon attaching the upper and lower bodies together, with the diaphragm therebetween, a stacked height is defined of the upper and lower bodies, said at least one first fastener having a length equal to or less than said stacked height.

10. The diaphragm carburetor of claim 1 further comprising:

a rotary throttle valve carried by the mixing body, controlling air flow into the air-fuel mixing passage, and constructed and arranged for rotation about and movement along an axis; and an elongated fuel nozzle communicating with the fuel metering chamber, carried by the upper body, disposed generally concentrically to the axis and projecting removably into the mixing body.

11. The diaphragm carburetor of claim 1 further comprising:

a fuel passage disposed in part in the mixing body and in part in the upper body and extending between the fuel metering chamber and the mixing passage; and a restricted orifice cartridge interposed in the fuel passage, projecting outward from the upper body and removably into the mixing body.

12. The diaphragm carburetor of claim 11 further comprising:

a face carried by the upper body through which the restricted orifice cartridge projects; and the fuel passage having a leg portion in the upper body and extending between the fuel nozzle and a port carried by the face and wherein the leg portion does not communicate directly with the fuel metering chamber.

13. A diaphragm carburetor for an internal combustion engine, comprising:

an air-fuel mixing body having an air-fuel mixing passage and at least one threaded bore;

a throttle valve received in the air-fuel mixing passage;

a fuel nozzle;

a fuel metering chamber assembly having a diaphragm, an upper body and a lower body separable from one another, the fuel nozzle extending from the upper body for receipt within the air-fuel mixing passage, at least one of the upper and lower bodies having a threaded bore for threaded receipt of at least one first fastener to attach the bodies together with the diaphragm carried between the bodies to define a fuel metering chamber on one side of the diaphragm and an atmospheric chamber on the other side of the diaphragm, the upper and lower bodies having axially aligned through openings upon being attached to one another; and at least one second fastener having a threaded shank that extends through the axially aligned through openings and beyond the upper body for threaded receipt in the threaded bore in the air-fuel mixing body to attach the fuel metering chamber assembly to the air-fuel mixing body.

14. The diaphragm carburetor of claim 13 wherein said at least one first fastener has a threaded shank that terminates within one of the upper body or lower body.

15. The diaphragm carburetor of claim 13 wherein a pair of said first fasteners attach the upper and lower bodies together adjacent first diagonal corners and a pair of said second fasteners attach the fuel metering chamber assembly to the air-fuel mixing body adjacent second diagonal corners.

16. A method of assembling a diaphragm carburetor having an air-fuel mixing body with an air-fuel mixing passage defined therein, a fuel metering chamber assembly having an upper body and a lower body with a diaphragm carried between the upper and lower bodies to define a fuel metering chamber on one side of the diaphragm and an atmospheric chamber on the other side of the diaphragm, comprising the steps of:

attaching the upper body and the lower body together with at least one first fastener to provide the fuel metering chamber assembly; and attaching the fuel metering chamber assembly to the air-fuel mixing body with at least one second fastener separate from said at least one first fastener.

17. The method of claim 16 further including forming at least one threaded bore in the upper body and threading said at least one first fastener into the threaded bore for termination therein.

18. The method of claim 16 further including forming axially aligned through bores in said upper and lower bodies and disposing said at least one second fastener through the aligned through bores and beyond the upper body for attachment to the air-fuel mixing body.

19. The method of claim 18 further including forming at least one threaded opening in the air-fuel mixing body and threading said at least one second fastener therein.

20. The method of claim 16 comprising the further step of inserting a fuel restrictor orifice cartridge into a bore in the upper body before attaching the fuel metering chamber assembly to the air-fuel mixing body.

21. The method of claim 20 comprising the further step of aligning and inserting the fuel restricting orifice cartridge projecting upward from the upper body and a fuel nozzle projecting upward from the upper body with and into corresponding bores in the air-fuel mixing body before attaching the fuel metering assembly to the air-fuel mixing body.

* * * * *